US010920770B2

(12) United States Patent
Lesage et al.

(10) Patent No.: US 10,920,770 B2
(45) Date of Patent: Feb. 16, 2021

(54) VOLUMETRIC PUMP

(71) Applicant: Goodrich Actuation Systems SAS, Saint Ouen l'Aumone (FR)

(72) Inventors: Emmanuel Lesage, Aulnay sur Iton (FR); Martin Cantegrel, Versailles (FR)

(73) Assignee: GOODRICH ACTUATION SYSTEMS SAS, Buc (FR)

( * ) Notice: Subject to any disclaimer, the term of this patent is extended or adjusted under 35 U.S.C. 154(b) by 289 days.

(21) Appl. No.: 16/029,698

(22) Filed: Jul. 9, 2018

(65) Prior Publication Data

US 2019/0010934 A1 Jan. 10, 2019

(30) Foreign Application Priority Data

Jul. 7, 2017 (EP) ..... 17305891

(51) Int. Cl.
*F04B 53/14* (2006.01)
*F04B 17/04* (2006.01)
(Continued)

(52) U.S. Cl.
CPC ..... *F04B 53/148* (2013.01); *F04B 1/02* (2013.01); *F04B 7/04* (2013.01); *F04B 9/105* (2013.01);
(Continued)

(58) Field of Classification Search
CPC ..... F04B 53/148; F04B 9/113; F04B 9/115; F04B 9/135; F04B 49/22; F04B 7/04;
(Continued)

(56) References Cited

U.S. PATENT DOCUMENTS 2,458,294 A 1/1949 Parker
2,709,421 A * 5/1955 Avery ..... F15B 13/0435 137/625.63
(Continued)

FOREIGN PATENT DOCUMENTS

DE 102004042208 A1 1/2007
DE 102015016314 A1 6/2017
(Continued)

OTHER PUBLICATIONS

Extended European Search Report for International Application No. 17305891.8 dated Dec. 15, 2017, 8 pages.

*Primary Examiner* — Peter J Bertheaud
(74) *Attorney, Agent, or Firm* — Cantor Colburn LLP

(57) ABSTRACT

An apparatus for pumping a fluid from a fluid inlet to a fluid outlet is disclosed. The apparatus comprises: a spool axially movable within a cavity, wherein a first chamber is located at a first axial end of the cavity and a second chamber is located at a second axial end of the cavity, wherein the volume of the first chamber and the second chamber varies depending upon the axial position of the spool within the cavity; a valve movable between a first position and a second position, wherein in the first position the valve is configured to convey fluid from the fluid inlet to the first chamber and from the second chamber to the fluid outlet, and in the second position the valve is configured to convey fluid from the fluid inlet to the second chamber and from the first chamber to the fluid outlet.

14 Claims, 7 Drawing Sheets

(51) Int. Cl.

| | |
|---|---|
| ***F04B 7/04*** | (2006.01) |
| ***F04B 9/115*** | (2006.01) |
| ***F04B 9/135*** | (2006.01) |
| ***F04B 49/22*** | (2006.01) |
| ***F04B 9/113*** | (2006.01) |
| ***F04B 9/105*** | (2006.01) |
| ***F04B 1/02*** | (2006.01) |
| ***F04B 53/12*** | (2006.01) |
| *F04B 7/00* | (2006.01) |

(52) U.S. Cl.
CPC ..... *F04B 9/113* (2013.01); *F04B 9/115* (2013.01); *F04B 9/135* (2013.01); *F04B 17/04* (2013.01); *F04B 17/042* (2013.01); *F04B 17/044* (2013.01); *F04B 49/22* (2013.01); *F04B 53/125* (2013.01); *F04B 7/0015* (2013.01); *F04B 7/0076* (2013.01)

(58) Field of Classification Search
CPC ..... F04B 9/105; F04B 9/1178; F04B 17/04; F04B 17/042; F04B 17/044; F04B 1/00
USPC ..... 417/404, 418, 501, 507, 510
See application file for complete search history.

(56) References Cited

U.S. PATENT DOCUMENTS

| | | | | | |
|---|---|---|---|---|---|
| 3,071,014 | A | * | 1/1963 | Gardner, Jr. | F04B 53/148 74/60 |
| 3,890,064 | A | * | 6/1975 | Boehringer | F01L 23/00 417/237 |
| 4,233,002 | A | | 11/1980 | Birenbaum | |
| 4,368,008 | A | * | 1/1983 | Budzich | F01L 25/06 417/267 |
| 5,564,912 | A | * | 10/1996 | Peck | F04B 9/113 417/396 |
| 5,718,570 | A | * | 2/1998 | Beckett | F16H 39/10 137/625.21 |
| 5,733,105 | A | | 3/1998 | Beckett et al. | |
| 5,893,707 | A | * | 4/1999 | Simmons | F04B 43/1136 417/393 |

FOREIGN PATENT DOCUMENTS

| | | | |
|---|---|---|---|
| FR | 1100976 | A | 9/1955 |
| FR | 443698 | A | 9/2012 |

* cited by examiner

VOLUMETRIC PUMP

FOREIGN PRIORITY

This application claims priority to European Patent Application No. 17305891.8 filed on Jul. 7, 2017, the entire contents of which is incorporated herein by reference.

FIELD

The present disclosure relates generally to a new type of pump architecture that uses the principles of an electro-hydrostatic actuator to pump fluid from a first reservoir to a second reservoir.

BACKGROUND

Volumetric pumps are known that use pistons moving alternately within cylinders, and conventionally use non-return valves or valve plates to drive a flow of fluid in a given direction. The rotary motion of a motor is typically converted to linear motion of one or more reciprocating pistons. This may be achieved through the use of a rotary cam, driven by the motor, that reciprocates the pistons as the cam rotates.

When the rotary cam is in a first rotational position, a first of the pistons may be reciprocating in a direction that expels fluid through a first non-return valve and out of a first pumping chamber, and a second of the pistons may be reciprocating in a direction that draws fluid through a second non-return valve and into a second pumping chamber. When the rotary cam has moved to a second rotational position, the first of the pistons may be reciprocating in a direction that draws fluid into the first pumping chamber, and the second of the pistons may be reciprocating in a direction that expels fluid out of the second pumping chamber. In this manner, it may be achievable to have fluid being pumped to a certain location, e.g., from the first or second pumping chamber the direction being determined by the operating directions of the non-return valve. The fluid may be pumped in a substantially constant manner to achieve a substantially continuous outflow of fluid.

Other conventional pump arrangements are known, for example a bent axis pump, valve pump, radial piston pump, axial piston pump and others. These have similar deficiencies with respect to the rotary volumetric pumps, in that they use a rotational motor with bearings, and use mechanical devices in the pump (e.g., cams, sliding shoes, etc.) to transform rotary motion of the motor to linear motion of the pistons It is desired to improve pump efficiency of conventional rotary volumetric pumps, whilst reducing the cost of the pump, the number of parts and increasing the life of the pump.

SUMMARY

In accordance with an aspect of the invention, there is provided an apparatus for conveying a fluid from a fluid inlet to a fluid outlet, the apparatus comprising: a spool axially movable within a cavity, wherein a first chamber is located at a first axial end of the cavity and a second chamber is located at a second axial end of the cavity, wherein the volume of the first chamber and the second chamber varies depending upon the axial position of the spool within the cavity; a valve movable between a first position and a second position, wherein in the first position the valve is configured to convey fluid from the fluid inlet to the first chamber and from the second chamber to the fluid outlet, and in the second position the valve is configured to convey fluid from the fluid inlet to the second chamber and from the first chamber to the fluid outlet; and a control system configured to control the movement of the spool and the valve.

The above-described apparatus provides a pump architecture that pumps fluid from a first reservoir (e.g., in fluid communication with the fluid inlet) to a second reservoir (e.g., in fluid communication with the fluid outlet) using a spool and cooperating valve. This has been found to provide an improved pump efficiency by reducing friction due to motion conversion (e.g., that is otherwise exhibited in pumps that use rotary shafts and convert this rotational motion to linear movement of a piston). The efficiency may be further increased by reducing internal leakage, due to the elimination of certain components such as piston shoes and valve ports. There is also a low initial force when starting the apparatus, in contrast to rotary systems that have to initiate rotation of a shaft with a high static friction. Further technical effects are described elsewhere herein.

The control system may be configured to synchronise the movement of the spool with the valve, such that: (i) when the valve is in its first position the control system is configured to move the spool in a first axial direction to increase the volume of the first chamber and decrease the volume of the second chamber, thus conveying fluid from the fluid inlet to the first chamber and from the second chamber to the fluid outlet; and (ii) when the valve is in its second position the control system is configured to move the spool in a second, opposite axial direction to increase the volume of the second chamber and decrease the volume of the first chamber, thus conveying fluid from the fluid inlet to the second chamber and from the first chamber to the fluid outlet.

Movement of the spool in the first axial direction may draw fluid from the fluid inlet into the first chamber, and push fluid from the second chamber to the fluid outlet.

Movement of the spool in the second, opposite axial direction may draw fluid from the fluid inlet into the second chamber and push fluid from the first chamber to the fluid outlet.

The control system may be configured to reciprocate the spool within the cavity and move the valve between its first position and second position, in such a manner as to provide an intermittent or regular flow of fluid through the fluid outlet. That is, upon reciprocation of the spool within the cavity, fluid may flow through the fluid outlet alternately from the first chamber and the second chamber, based, for example, on the direction of movement of the spool and the position of the valve.

In accordance with an aspect of the invention, there is provided a method of operating an apparatus as described above, the method comprising, in sequence: moving the first spool to increase the volume of the first chamber of the first valve and decrease the volume of the second chamber of the first valve; and moving the first spool to increase the volume of the second chamber of the first valve and decrease the volume of the first chamber of the first valve.

The apparatus may further comprise one or more actuators configured to move the first spool within the cavity, and the valve between the first position and the second position.

Any or all of the one or more actuators may comprise solenoid actuators, piezoelectric actuators or memory material actuators.

The spool and the cavity may be a first spool and a first cavity respectively, and the apparatus may further comprises a first valve comprising the first spool, the first cavity, the first chamber and the second chamber. The valve may be a second valve and may comprise a second spool axially movable within a second cavity, wherein a first chamber of the second valve may be located at a first axial end of the second cavity and a second chamber of the second valve is located at a second axial end of the second cavity, wherein the volume of the first chamber and the second chamber varies depending upon the axial position of the second spool within the cavity.

The first valve may be movable between a first position and a second position. In the first position the first valve may be configured to convey fluid from the fluid inlet to the first chamber of the second valve, and from the second chamber of the second valve to the fluid outlet. In the second position the first valve may be configured to convey fluid from the fluid inlet to the second chamber of the second valve and from the first chamber of the second valve to the fluid outlet.

The control system may be configured to synchronise the movement of the second spool with the first valve, such that: (iii) when the first valve is in its first position the control system is configured to move the second spool in a first axial direction to increase the volume of the first chamber of the second valve and decrease the volume of the second chamber of the second valve, thus conveying fluid from the fluid inlet to the first chamber of the second valve and from the second chamber of the second valve to the fluid outlet; and (iv) when the first valve is in its second position the control system is configured to move the second spool in a second, opposite axial direction to increase the volume of the second chamber of the second valve and decrease the volume of the first chamber of the second valve, thus conveying fluid from the fluid inlet to the second chamber of the second valve and from the first chamber of the second valve to the fluid outlet.

Movement of the second spool in the first axial direction may draw fluid from the fluid inlet into the first chamber of the second valve, and push fluid from the second chamber of the second valve to the fluid outlet.

Movement of the second spool in the second, opposite axial direction may draw fluid from the fluid inlet into the second chamber of the second valve and push fluid from the first chamber of the second valve to the fluid outlet.

The control system may be configured to reciprocate the spools within their respective cavities, and move the first valve and the second valve between their respective first and second positions, in such a manner as to provide a substantially continuous flow of fluid through the fluid outlet. That is, upon reciprocation of the spools within their respective cavities, fluid may flow through the fluid outlet continuously from the first and second chambers of the first and second valves, based, for example, on the direction of movement of each spool and the position of the first and second valves.

The first and second chambers of the first valve may be substantially fluidly sealed from one another, for example by the first spool, such that fluid may not be conveyed between the first and second chambers of the first valve in use. One or more seals may be located on the first spool to provide this functionality.

Similarly, the first and second chambers of the second valve may be substantially fluidly sealed from one another, for example by the second spool, such that fluid may not be conveyed between the first and second chambers of the second valve in use. One or more seals may be located on the second spool to provide this functionality.

The control system may be configured to apply stages (i), (ii), (iii) and (iv) in a specific sequence, so as to provide a continuous flow of fluid from the fluid inlet to the fluid outlet. The sequence may be (i), (iii), (ii), (iv), or the sequence is (iv), (ii), (iii), (i).

The apparatus may further comprise one or more actuators configured to move the second spool within the second cavity, and the first valve between the first position and the second position. Any or all of the one or more actuators may comprise solenoid actuators, piezoelectric actuators or memory material actuators.

In accordance with an aspect of the invention, there is provided a method of operating an apparatus as described above, the method comprising, in sequence: moving the first spool to increase the volume of the first chamber of the first valve and decrease the volume of the second chamber of the first valve; moving the second spool to increase the volume of the first chamber of the second valve and decrease the volume of the second chamber of the second valve; moving the first spool to increase the volume of the second chamber of the first valve and decrease the volume of the first chamber of the first valve; and moving the second spool to increase the volume of the second chamber of the second valve and decrease the volume of the first chamber of the second valve.

BRIEF DESCRIPTION OF THE DRAWINGS

Various embodiments will now be described, by way of example only, and with reference to the accompanying drawings in which.

DETAILED DESCRIPTION

Figure 1B:
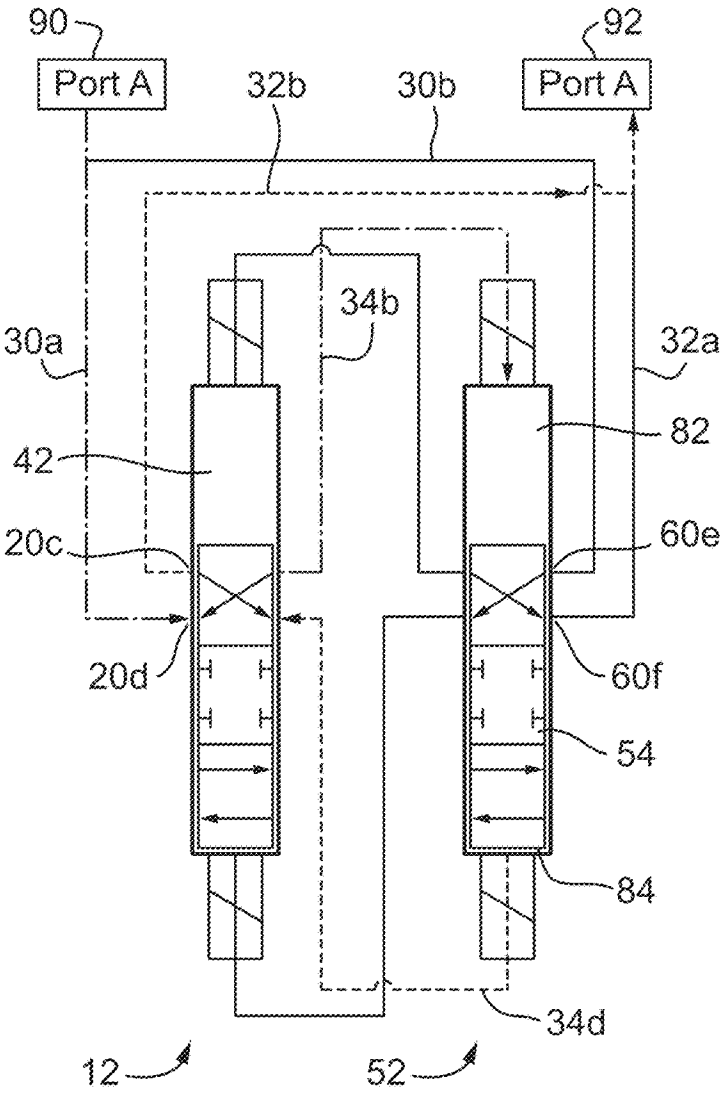
FIGS. 1A-1D show a fluid flow diagram of an apparatus or pump in accordance with a first embodiment of the disclosure.

The present disclosure relates to the use of an architecture employed in hydraulic systems, in combination with electric solenoid valves to provide a method of pumping a fluid, for example between two reservoirs. The operation of the disclosed architecture is similar to that of reciprocating pistons, and indeed pistons are used in the present architecture, but the use of a rotary motor is eliminated.

FIGS. 1A-1D show schematically (in the form of a fluid flow diagram) an embodiment of an apparatus in the form of a pump 10, in an example that uses two distribution valves, each having a single spool to provide four configurations that are applied in sequence to induce flow of a fluid. The pump 10 comprises a first main port 90 and a second main port 92 and in the configuration of FIGS. 1A-1D the sequence is such that fluid flows from the first main port 90 to the second main port 92, as will be described in more detail below. In other words, the first main port 90 is a fluid inlet, and the second main port 92 is a fluid outlet.

A first valve 12 is provided, and comprises a spool 14 in the form of a movable piston that is configured to move within a first cavity 40 of the first valve 12. Two solenoids 18 (which may be controlled in parallel or separately) are configured to move the spool 14 within the first cavity 40, although any suitable actuator or pair of actuators may be used for this purpose, such as a piezoelectric actuator or memory material actuator.

The first valve 12 comprises six ports 20*a-f*, each being in fluid communication with a specific fluid passage that fluidly connects the port in question with another port of the pump 10. Two of the ports 20*a*, 20*b* are located at either axial end of the first valve 12, and are each fluidly connected to a respective variable volume chamber 42, 44.

Figure 1A:
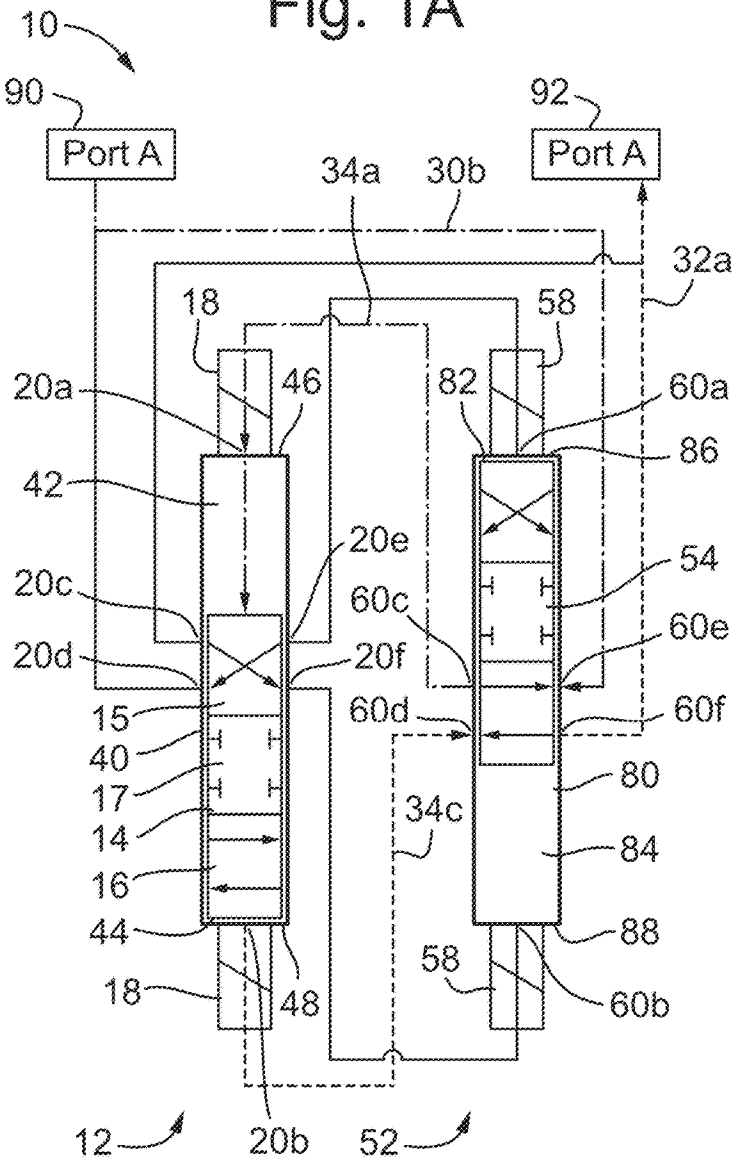
Figure 1D:
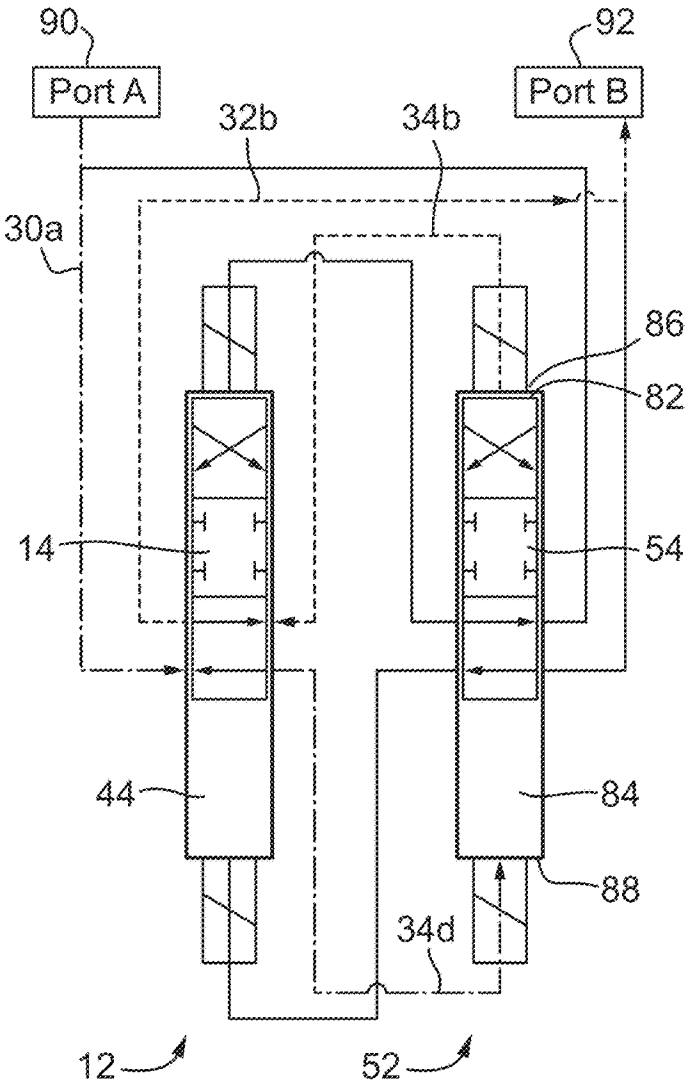
Figure 1C:
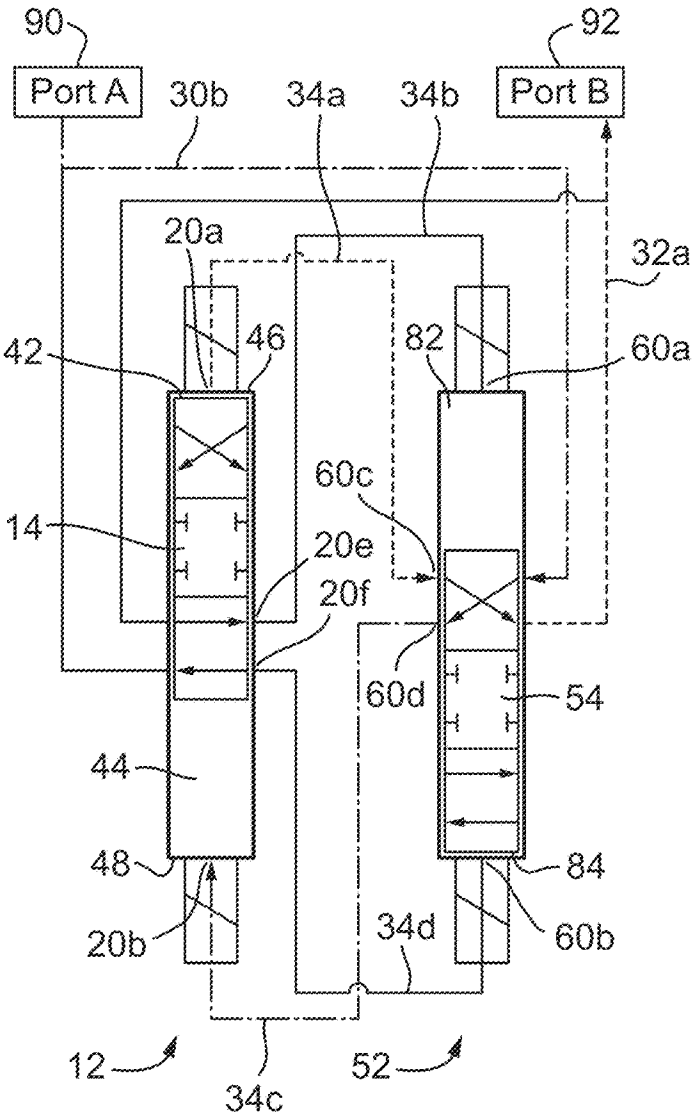

The volume of each chamber 42, 44 varies depending on the position of the spool 14 within the first cavity 40, and the first valve 12 is configured such that the volumes of the chambers 42, 44 are inversely proportional with one another. That is, when a first 42 of the chambers is at a maximum volume, the second 44 of the chambers is at a minimum volume (as shown in FIG. 1A), and vice versa (as shown in FIG. 1C).

The spool 14 moves within the first cavity 40 from a first axial end 46 to a second axial end 48, wherein the first chamber 42 is located at the first axial end 46 and the second chamber 44 is located at the second axial end 48. As the spool 14 moves, one of the chambers 42, 44 will be increasing in volume and the other of the chambers 42, 44 will be decreasing in volume. In other words, the volume of each of the chambers 42, 44 is dictated by the position of the spool 14 within the first cavity 40. In FIG. 1A, for example, the spool 14 is at the limit of its travel towards the second axial end 48, such that the volume of the second chamber 44 is at a minimum (or zero), and the volume of the first chamber 42 is at a maximum.

Movement of the spool 14 in a given axial direction will cause fluid to be drawn into one of the chambers 42, 44 and at the same time expelled from the other of the chambers 42, 44. The first and second chambers 42, 44 are fluidly sealed from one another, for example by the spool 14, such that fluid may not be conveyed between the first and second chambers 42, 44 in use. One or more seals (not shown) may be located on the spool 14 to provide this functionality.

The spool 14 is configured to control the fluid connections between four of the ports 20*c-f* based on its axial position within the first cavity 40. Three configurations 15, 16, 17 are provided. In a first axial position (as shown in FIGS. 1A and 1B), corresponding to a first configuration 15, the spool 14 is configured to fluidly connect port 20*c* with port 20*f*, as well as port 20*d* with port 20*e*. In a second axial position (as shown in FIGS. 1C and 1D), corresponding to a second configuration 16, the spool 14 is configured to fluidly connect port 20*c* with port 20*e*, as well as port 20*d* with port 20*f*. A third configuration 17 may be provided (which is an optional configuration) corresponding to a position of the spool 14 in which the fluid connections between the ports 20*c*-20*f* are blocked.

The pump 10 further comprises a second valve 52, which has the same features as the first valve 12. The features of the second valve 52 that correspond to similar features of the first valve 12 have the same reference numerals as those of the first valve 12, but with '40' added to them. For example, the spool of the second valve 52 is shown with reference numeral '54', and has the same features as the first spool 14.

The operation of the second valve 52 is the same as that of the first valve 12, so will not be described in detail again. The key difference is that the position of the second spool 54 does not follow the same sequence as the first spool 14, which can provide a continuous flow of fluid out of the pump 10.

Similarly with respect to the first valve 12, the first and second chambers 82, 84 of the second valve 52 are fluidly sealed from one another, for example by the second spool 54, such that fluid may not be conveyed between the first and second chambers 82, 84 of the second valve in use. One or more seals (not shown) may be located on the second spool 54 to provide this functionality.

Various fluid connections (e.g., fluid passages) are provided within the pump 10, and these are shown in FIGS. 1A-1D. For clarity purposes, the reference numerals are not repeatedly shown in FIGS. 1A-1D, although it may be assumed that the pump 10 is the same in each of FIGS. 1A-1D, with the exception of the position of the spools 14, 54 and the fluid connections between the various ports.

As shown in FIG. 1B, the first main port 90 is fluidly connected to the first valve 12 and the second valve 52, for example port 20*d* of the first valve 12 (via fluid passage 30*a*) and port 60*e* of the second valve 52 (via fluid passage 30*b*). The second main port 92 is also fluidly connected to the first valve 12 and the second valve 52, for example port 20*c* of the first valve 12 (via fluid passage 32*b*) and port 60*f* of the second valve 52 (via fluid passage 32*a*).

As a result, the first main port 90 and the second main port 92 are fluidly connected to the spools 14, 54 of the first valve 12 and the second valve 52 respectively, such that fluid flow from or to the first main port 90 or the second main port 92 is dictated by the position of the spools 14, 54 within their respective cavities 40, 80.

The first valve 12 is also fluidly connected to the second valve 52 via various fluid connections (e.g., fluid passages).

For example, as shown in FIG. 1C, the first chamber 42 of the first valve 12 is fluidly connected to the second valve 52, for example port 20*a* of the first valve 12 is fluidly connected to port 60*c* of the second valve 52 via fluid passage 34*a*. Similarly, the first chamber 82 of the second valve 52 is fluidly connected to the first valve 12, for example port 60*a* of the second valve 52 is fluidly connected to port 20*e* of the first valve 12 via fluid passage 34*b*.

The second chamber 44 of the first valve 12 is fluidly connected to the second valve 52, for example port 20*b* of the first valve 12 is fluidly connected to port 60*d* of the second valve 52 via fluid passage 34*c*. Similarly, the second chamber 84 of the second valve 52 is fluidly connected to the first valve 12, for example port 60*b* of the second valve 52 is fluidly connected to port 20*f* of the first valve 12 via fluid passage 34*d*.

As a result, the first and second chambers 42, 44 of the first valve 12 are fluidly connected to the second spool 54 for onward fluid connection to the first main port 90 or second main port 92, as dictated by the axial position of the second spool 54. Similarly, the first and second chambers 82, 84 of the second valve 52 are fluidly connected to the first spool 14 for onward fluid connection to the first main port 90 or second main port 92, as dictated by the axial position of the first spool 14.

The ports 20*c*, 20*d*, 60*e* and 60*f* may be referred to as external ports of the first valve 12 and the second valve 52 respectively, in that they provide a fluid connection between the first valve 12 or the second valve 52 and the first main port 90 or the second main port 92.

The ports 20*a*, 20*b*, 20*e*, 20*f*, 60*a*, 60*b*, 60*c* and 60*d* may be referred to as internal ports of the first valve 12 and the second valve 52 respectively, in that they provide a fluid connection between the first valve 12 and the second valve 52.

The sequence of movements of the spools 14, 54 of the first valve 12 and the second valve 52 will now be described.

In FIG. 1A, the first spool 14 is at the limit of its travel towards the second axial end 48 of the first cavity 40, such that the first chamber 42 of the first valve 12 is at a maximum volume and the second chamber 44 of the first valve 12 is at a minimum volume. The second spool 54 is at the limit of its travel towards the first axial end 86 of the second cavity 80, such that the first chambers 82 of the second valve 52 is at a minimum volume and the second chamber 84 of the second valve 52 is at a maximum volume.

FIG. 1B shows the configuration of the pump 10 after a first stage of the sequence, wherein the second spool 54 has moved to the opposite end 88 of the second cavity 80. As such, fluid is drawn into the first chamber 82 of the second valve 52 from the first main port 90. To achieve this, the fluid is drawn through the fluid passage 34*b*, which fluidly connects the first chamber 82 of the second valve 52 with the first spool 14, and the fluid passage 30*a*, which fluidly connects the first main port 90 (corresponding to the input flow in this example) and the first spool 14.

At the same time, the fluid that was located in the second chamber 84 of the second valve 52 (see FIG. 1A) has now been expelled from this chamber 84 to the second main port 92 via the first valve 12. To achieve this, the fluid is conveyed through the fluid passage 34*d*, which fluidly connects the second chamber 84 of the second valve 52 with the first spool 14, and the fluid passage 32*b*, which fluidly connects the first spool 14 with the second main port 92 (corresponding to the output flow in this example).

The first spool 14 does not substantially move (or move at all) in the first stage of the sequence.

FIG. 1C shows the configuration of the pump 10 after a second stage of the sequence, wherein the first spool 14 has moved from the second axial end 48 to the first axial end 46. As such, fluid is drawn into the second chamber 44 of the first valve 12 from the first main port 90. To achieve this, the fluid is drawn through the fluid passage 34*c*, which fluidly connects the second chamber 44 of the first valve 12 with the second spool 54, and a fluid passage 30*b*, which fluidly connects the second spool 54 with the first main port 90.

At the same time, the fluid that was located in the first chamber 42 of the first valve 12 (see FIG. 1B) has now been expelled from this chamber 42 to the second main port 92 via the second valve 52. To achieve this, the fluid is conveyed through the fluid passage 34*a*, which fluidly connects the first chamber 42 of the first valve 12 with the second spool 54, and the fluid passage 32*a*, which fluidly connects the second spool 54 with the second main port 92.

The second spool 54 does not substantially move (or move at all) in the second stage of the sequence.

FIG. 1D shows the configuration of the pump 10 after a third stage of the sequence, wherein the second spool 54 has moved from the second axial end 88 to the first axial end 86. As such, fluid is drawn into the second chamber 84 of the second valve 52 from the first main port 90. To achieve this, the fluid is drawn through the fluid passage 34*d*, which fluidly connects the second chamber 84 of the second valve 52 with the first spool 14, and fluid passage 30*a*, which fluidly connects the first spool 14 with the first main port 90.

At the same time, the fluid that was located in the first chamber 82 of the second valve 52 (see FIG. 1C) has now been expelled from this chamber 82 to the second main port 92 via the first valve 12. To achieve this, the fluid is conveyed through the fluid passage 34*b*, which fluidly connects the first chamber 82 of the second valve 52 with the first spool 14, and the fluid passage 32*b*, which fluidly connects the first spool 14 with the second main port 92.

The first spool 14 does not substantially move (or move at all) in the third stage of the sequence.

FIG. 1A shows the configuration of the pump 10 after a fourth stage of the sequence, wherein the first spool 14 has moved from the first axial end 46 to the second axial end 48. As such, fluid is drawn into the first chamber 42 of the first valve 12 from the first main port 90. To achieve this, the fluid is drawn through the fluid passage 34*a*, which fluidly connects the first chamber 42 of the first valve 12 with the second spool 54, and the fluid passage 30*b*, which fluidly connects the second spool 54 with the first main port 90.

At the same time, the fluid that was located in the second chamber 44 of the first valve 12 (see FIG. 1D) has now been expelled from this chamber 44 to the second main port 92 via the second valve 52. To achieve this, the fluid is conveyed through the fluid passage 34*c*, which fluidly connects the second chamber 44 of the first valve 12 with the second spool 54, and the fluid passage 32*a*, which fluidly connects the second spool 54 with the second main port 92.

At this point the sequence is repeated, such that the first stage (corresponding to the transition between FIGS. 1A and 1B) follows on from the fourth stage. The sequence may be repeated indefinitely to provide a constant flow of fluid from the first main port 90 to the second main port 92.

FIGS. 2A-2D show schematically (in the form of a fluid flow diagram) an embodiment of the present disclosure that uses the same pump 10 as used in FIGS. 1A-1D, but in reverse sequence, such that fluid flows from the second main port 92 to the first main port 90, such that the second main port 92 is a fluid inlet and the first main port 90 is a fluid outlet.

Figure 2B:
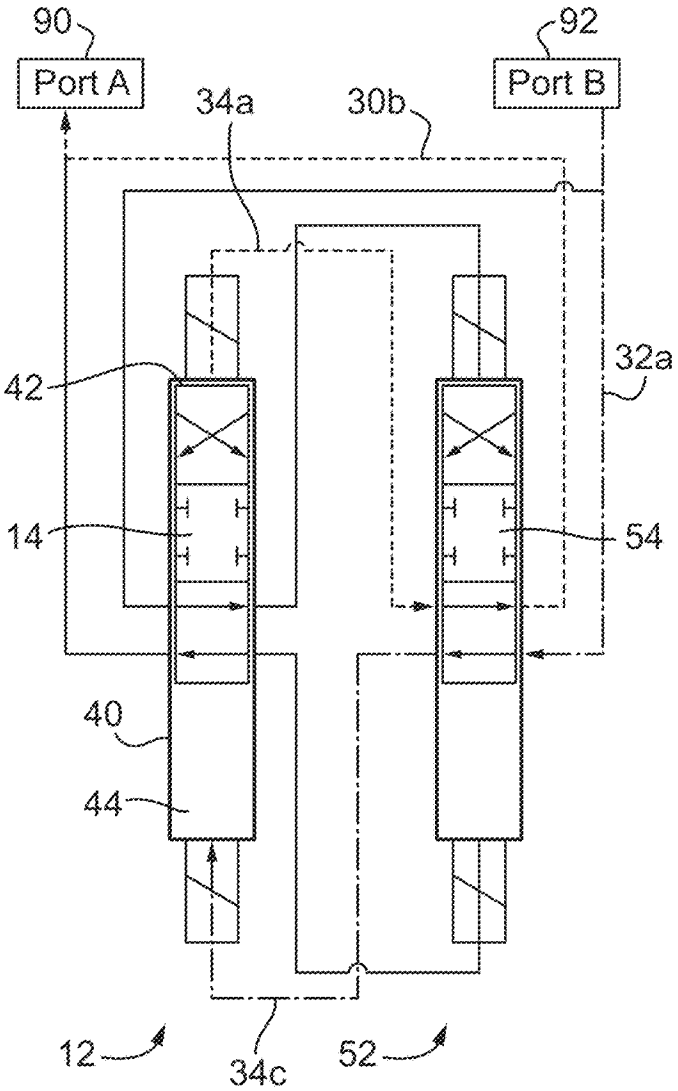
FIGS. 2A-2D show a fluid flow diagram of the apparatus of FIGS. 1A-1D operating in a reverse cycle.

In a first stage, as shown in FIG. 2B, the first spool 14 moves within the first cavity 40 to expel fluid from the first chamber 42 to the first main port 90 via the second spool 54 (fluid may be conveyed through the fluid passages 34*a* and 30*b*). At the same time, fluid is drawn into the second chamber 44 of the first valve 12 from the second main port 92 via the spool 54 (fluid may be conveyed through the fluid passages 32*a* and 34*c*).

Figure 2A:
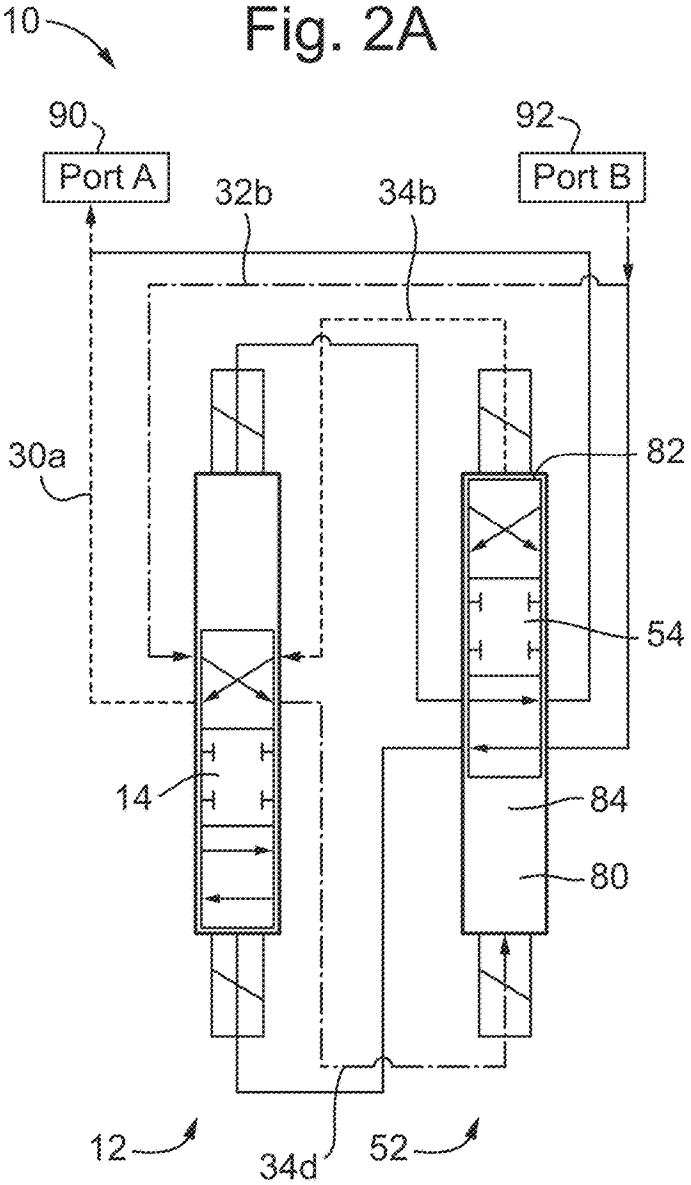
Figure 2D:
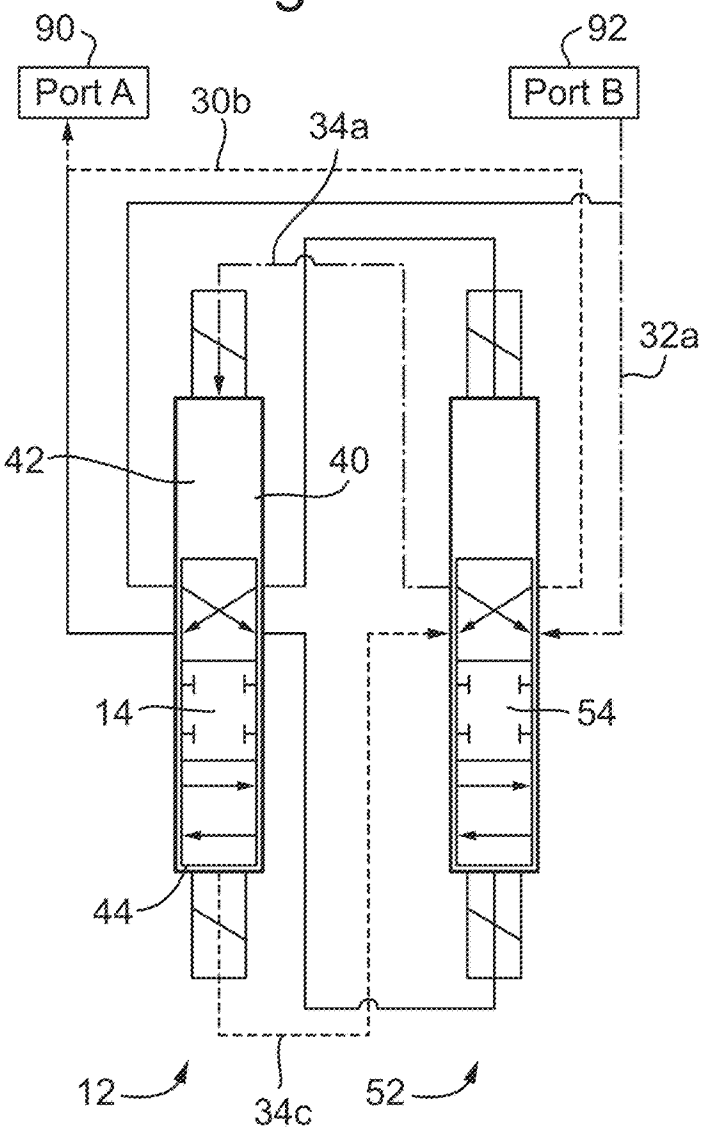
Figure 2C:
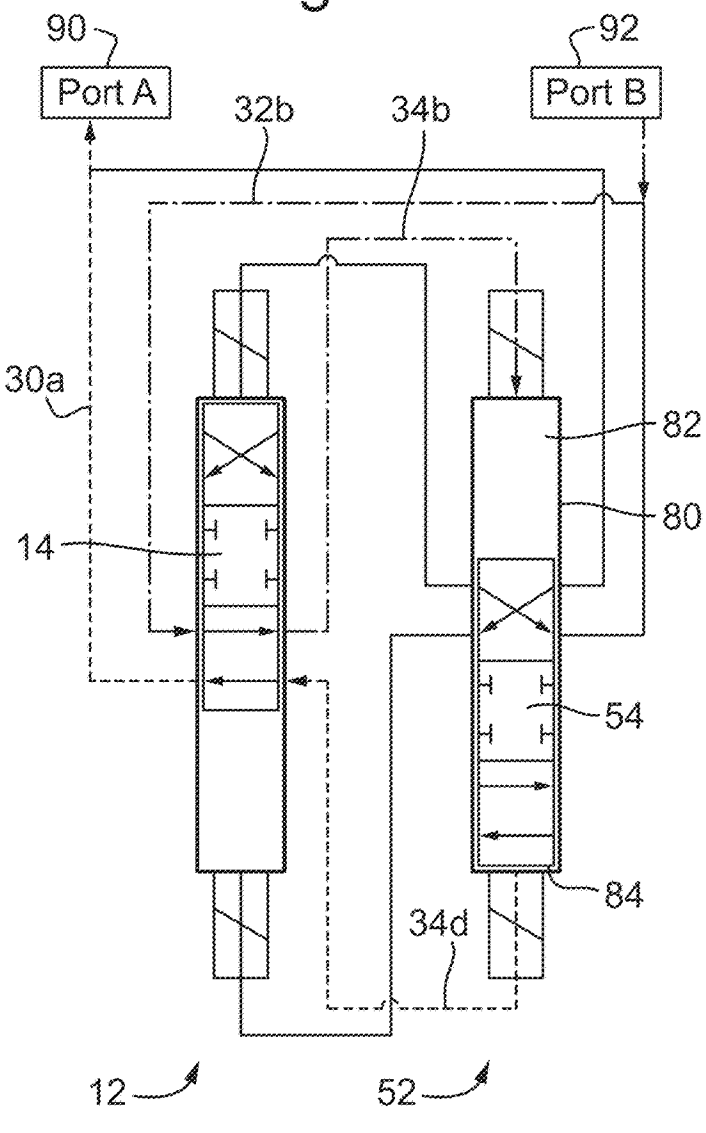

In a second stage, as shown in FIG. 2C, the second spool 54 moves within the second cavity 80 to expel fluid from the second chamber 84 of the second valve 52 to the first main port 90 via the first spool 14 (fluid may be conveyed through the fluid passages 34*d* and 30*a*). At the same time, fluid is drawn into the first chamber 82 of the second valve 52 from the second main port 92 via the first spool 14 (fluid may be conveyed through the fluid passages 32*b* and 34*b*).

In a third stage, as shown in FIG. 2D, the first spool 14 moves within the first cavity 40 to expel fluid from the second chamber 44 of the first valve 12 to the first main port 90 via the second spool 54 (fluid may be conveyed through the fluid passages 34*c* and 30*b*). At the same time, fluid is drawn into the first chamber 42 of the first valve 12 from the second main port 92 via the second spool 54 (fluid may be conveyed through the fluid passages 32*a* and 34*a*).

In a fourth stage, as shown in FIG. 2A, the second spool 54 moves within the second cavity 80 to expel fluid from the first chamber 82 of the second valve 52 to the first main port 90 via the first spool 14 (fluid may be conveyed through the fluid passages 34*b* and 30*a*). At the same time, fluid is drawn into the second chamber 84 of the second valve 52 from the second main port 92 fire the first spool 14 (fluid may be conveyed through the fluid passages 32*b* and 34*d*.

Figure 3:
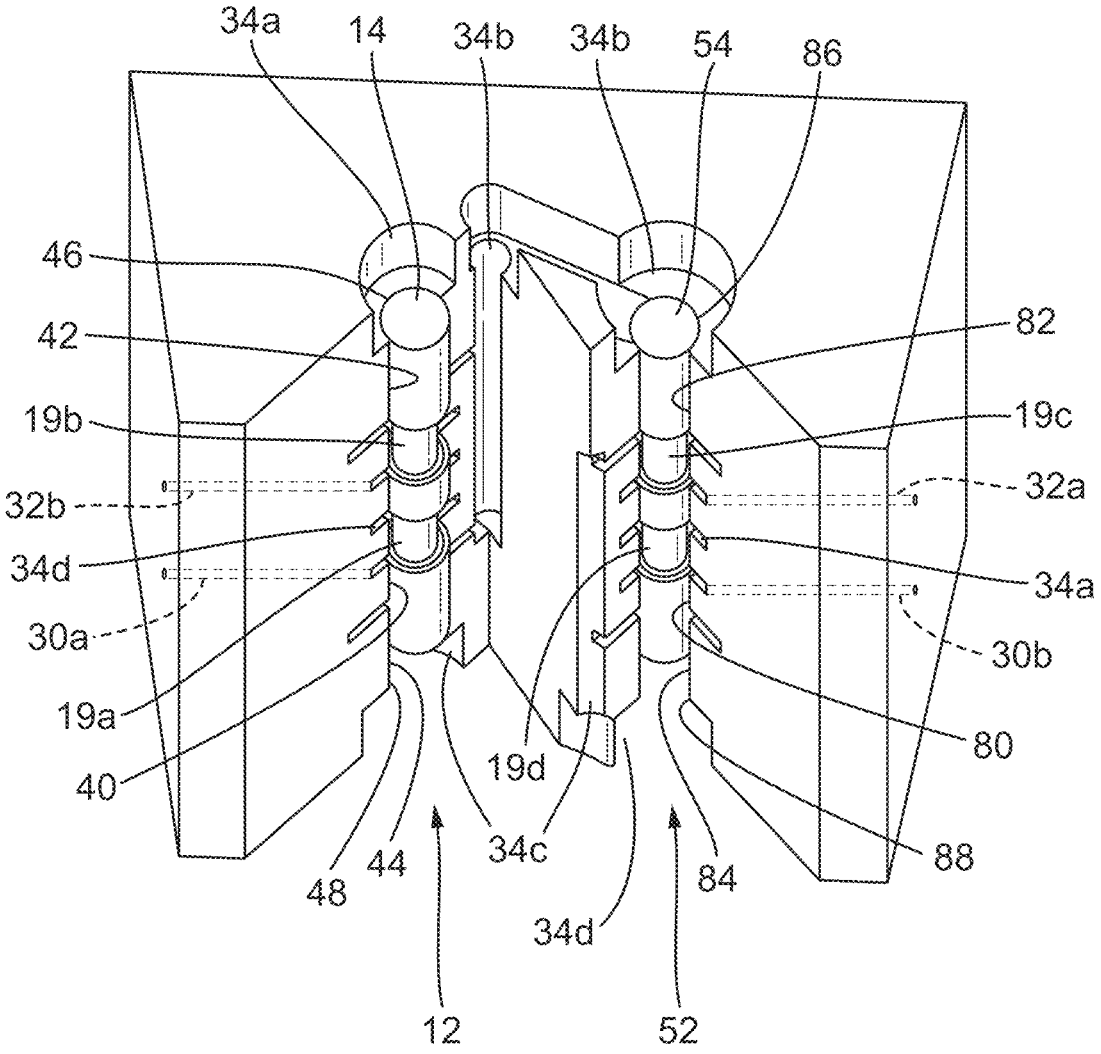
FIG. 3 shows an architecture that may be employed to carry out the fluid sequences shown in FIGS. 1A-1D and 2A-2D.

FIG. 3 shows an architecture for the pump 10 of FIGS. 1A-1D and 2A-2D, although it will be appreciated that other architectures are possible.

The two spools 14, 54 of the first valve 12 and the second valve 52 respectively can be seen in the cutaway portion of FIG. 3A, and are shown in their positions corresponding to FIGS. 1D and 2B. Each spool 14, 54 comprises an elongated cylinder that is movable within a respective first cavity 40, 80 between a respective first end 46, 86 and a respective second end 48, 88. Furthermore, each spool 14, 54 comprises cutaway portions 19*a-d* that are configured to transfer fluid between the various fluid passages depending on the axial position of the spool 14, 54.

For example, as shown in FIG. 3, a first cutaway portion 19*a* fluidly connects the fluid passage 30*a* with the fluid passage 34*d*. If the first spool 14 were to move down, then the first cutaway portion 19*a* would instead fluidly connect the fluid passage 30*a* with these fluid passage 34*b*. A second cutaway portion 19*b* fluidly connects the fluid passage 32*b* with either the fluid passage 34*b* (as shown in FIG. 3) or the fluid passage 34*d*. A third cutaway portion 19*c* fluidly connects the fluid passage 32*a* with either the fluid passage 34*c* (as shown in FIG. 3), or the fluid passage 34*a*. Finally, a fourth cutaway portion 19*d* fluidly connects the fluid passage 30*b* with either the fluid passage 34*a* (as shown in FIG. 3), or the fluid passage 34*c*.

It will be appreciated that only two portions of the fluid passages 34*d* and 34*a* are shown in FIG. 3. However, these passages have the same configuration as the fluid passages 34*b* and 34*c*, and it can be assumed that the portion of each passage 34*d*, 34*a* that is shown adjacent to the side of the respective spool 14, 54 fluidly connects with the portion of the passage 34*d*, 34*a* shown at the axial ends 88, 46 of the respective second cavity 80, 40.

Figure 4B:
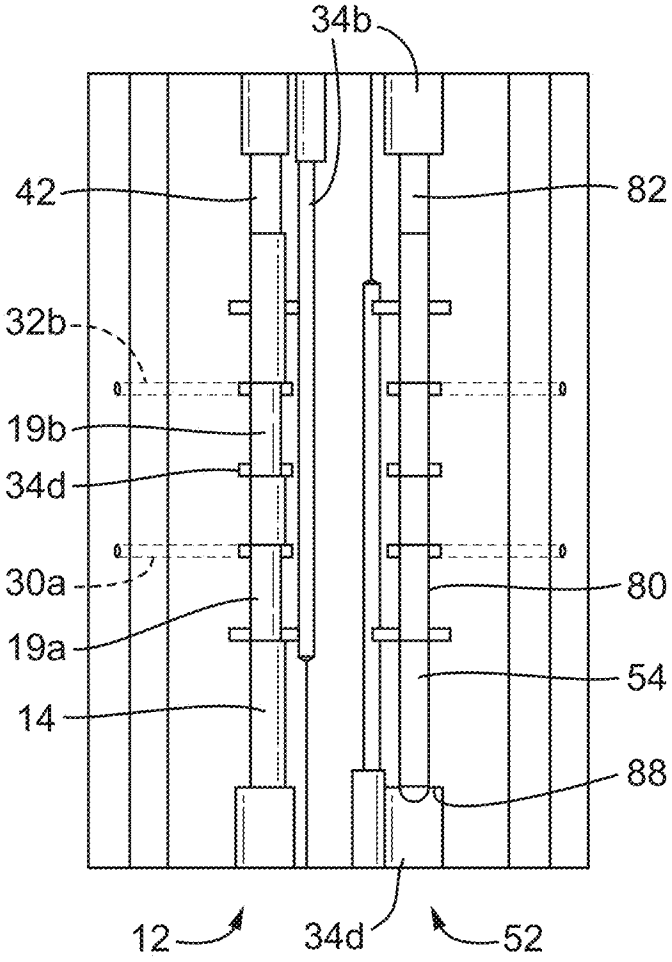
FIGS. 4A-4D show the fluid passages of FIG. 3 when applied in a sequence according to FIGS. 1A-1D.
Figure 4A:
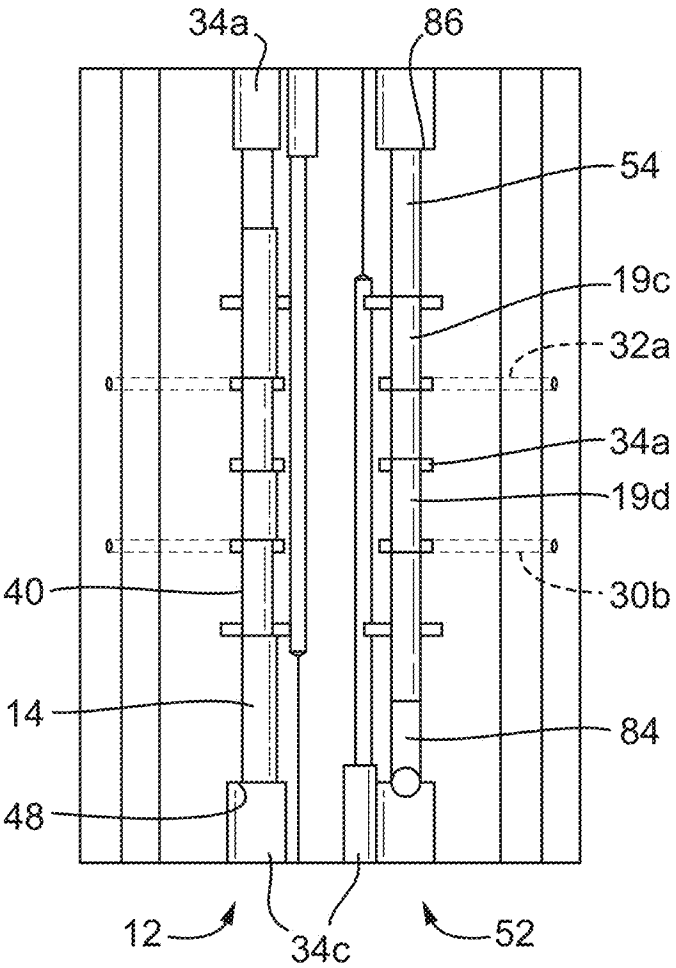

FIGS. 4A-4D correspond to the sequence shown in FIGS. 1A-1D (although the principles may be applied in reverse such that the sequence corresponds to that of FIGS. 2A-2D). FIG. 4A shows the first spool 14 at the limit of its travel towards the second axial end 48 of the first cavity 40, and the second spool 54 at the limit of its travel towards the first axial end 86 of the second cavity 80.

FIG. 4B shows the second spool 54 having moved to the second axial end 88 of the second cavity 80, which forces fluid previously held within the second cavity 84 to travel through fluid passage 34*d* to the second cutaway portion 19*b* of the spool 14, so that it is onwardly conveyed to the second main port 92 via fluid passage 32*b*. At the same time, fluid from the first main port 90 is conveyed through fluid passage 30*a* to the first cutaway portion 19*a*, so that is it is onwardly conveyed to the first cavity 82 of the second valve 52 via the fluid passage 34*b*.

Figure 4D:
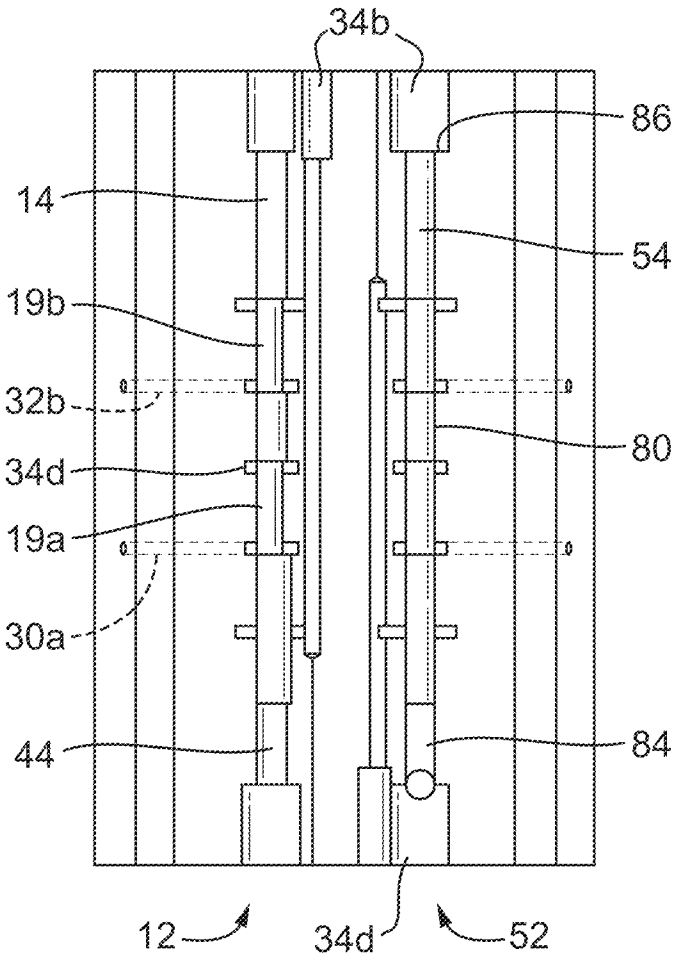
Figure 4C:
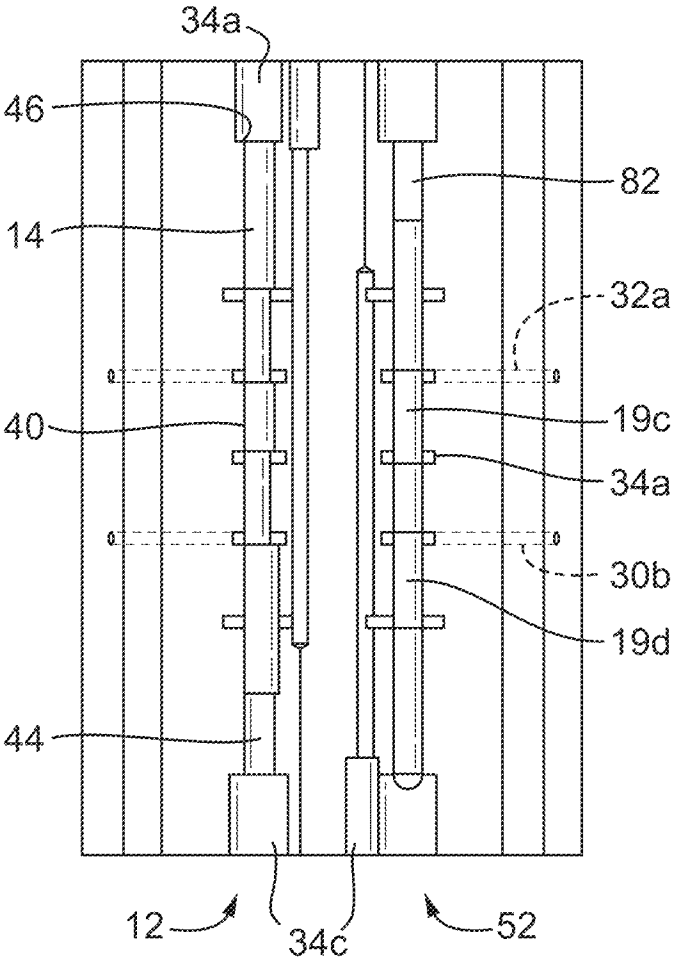

FIG. 4C shows the first spool 14 having moved to the first axial end 46 of the first cavity 40, which forces fluid previously held within the first cavity 42 to travel through fluid passage 34*a* to the third cutaway portion 19*c* of the spool 54, so that it is onwardly conveyed to the second main port 92 via fluid passage 32*a*. At the same time, fluid from the first main port 90 is conveyed through fluid passage 30*b* to the fourth cutaway portion 19*d*, so that is it is onwardly conveyed to the second cavity 44 of the first valve 12 via the fluid passage 34*c*.

FIG. 4D shows the spool 54 having moved to the first axial end 86 of the second cavity 80, which forces fluid previously held within the first cavity 82 to travel through fluid passage 34*b* to the second cutaway portion 19*b* of the first spool 14, so that it is onwardly conveyed to the second main port 92 via fluid passage 32*b*. At the same time, fluid from the first main port 90 is conveyed through fluid passage 30*a* to the first cutaway portion 19*a*, so that is it is onwardly conveyed to the second cavity 84 of the second valve 52 via the fluid passage 34*d*.

FIG. 4A shows the first spool 14 having moved to the second axial end 48 of the first cavity 40, which forces fluid previously held within the second cavity 44 to travel through fluid passage 34*c* to the third cutaway portion 19*c* of the spool 54, so that it is onwardly conveyed to the second main port 92 via fluid passage 32*a*. At the same time, fluid from the first main port 90 is conveyed through fluid passage 30*b* to the fourth cutaway portion 19*d*, so that is it is onwardly conveyed to the first cavity 42 of the first valve 12 via the fluid passage 34*a*.

The "four-stage" apparatus (or pump) described above may be used to provide a continuous outflow of fluid through the first or second main port 90, 92 (depending on the sequence). It will be appreciated that a single valve in combination with a single spool may be provided instead of the dual-valve and spool configuration described above.

For example, an apparatus may be provided in which a single spool or a plurality of separate spools are each axially movable within respective cavities, wherein a first chamber is located at a first axial end of each cavity and a second chamber is located at a second axial end of each cavity, wherein the volume of each first chamber and each second chamber varies depending upon the axial position of each respective spool within its cavity.

In addition, the apparatus may further comprise a single valve movable between a first position and a second position, wherein in the first position the valve is configured to convey fluid from the fluid inlet to the first chamber and from the second chamber to the fluid outlet, and in the second position the valve is configured to convey fluid from the fluid inlet to the second chamber and from the first chamber to the fluid outlet.

It will further, and alternatively be appreciated that more valves may be provided in addition to the two that are described in the above example. For example, four valves may be provided, each comprising a spool that is driven by two actuators (providing eight actuators in total).

The technology disclosed herein has been found to improve pump efficiency by reducing friction due to motion conversion that is otherwise exhibited in pumps that use rotary shafts and convert this rotational motion to linear movement of a piston. The efficiency is further increased by reducing internal leakage, due to the elimination of certain components such as piston shoes and valve ports. There is also a low initial force when starting the apparatus, in contrast to rotary systems that have to initiate rotation of a shaft with a high static friction.

The life of the pump may be improved due to the low friction of the parts and high reliability of the spool and valve configuration.

In addition, where a plurality of valves are provided there is an opportunity to provide a redundancy scenario, in which failure of one of the fluid pathways does not result in complete failure of the system. For example, a blockage in a fluid pathway in the embodiments described at FIGS. 1A-1D and 2A-2D would merely result in the control system switching to the single valve embodiment discussed above, and the pump could still provide a useful output. Where even more valves are provided, for example where four valves are provided, it may be possible to maintain a continuous fluid output even in the event of multiple blockages in the system.

The pump is disclosed herein may be seen as relatively inexpensive when compared to certain conventional arrangements. For example one of the most expensive parts in a rotary pump is a piston shoe, and this part is not required in the apparatus disclosed herein. Further reductions are achieved in the elimination of bearing and seal components required to convert rotary motion to linear motion in a fluidic environment, as well as the elimination of a rotary motor.

The actuators used in the present disclosure may be any type of linear actuator known in the art. The most common is a solenoid valve, and two may be provided at either end of the spool to move it in its respective cavity. Other possible actuators include piezoelectric actuators and memory material actuators.

The architecture disclosed herein may be used in an electro-hydrostatic actuator ("EHA"), which is a hydraulic actuator run and controlled by an electrically powered motor assembly. Typically, these are rotary motors such as a radial piston pump, axial piston pump, bent axis pump or valve pump. As the present apparatus is able to direct a fluid flow in two opposing directions (i.e., through either the first main port 90 or the second main port 92), the pump is disclosed herein could replace the motor of such an actuator.

In certain applications, an electro-hydrostatic actuator incorporating the pump of the present disclosure may benefit from the benefits of the pump described above. For example in operation of an aircraft, it is important to provide redundancy in the event of electrical power generation failure or control path electronics failure (or blockage of fluid parts). Given that the pump of the present disclosure is able to provide a degree of redundancy when a plurality of valves are provided, this may be used in such an application in order to achieve specification requirements for electro-hydrostatic actuators in new aircraft requirements.

Although the present invention has been described with reference to preferred embodiments, it will be understood by those skilled in the art that various changes in form and detail may be made without departing from the scope of the invention as set forth in the accompanying claims.

The invention claimed is:

1. An apparatus for conveying a fluid from a fluid inlet to a fluid outlet, the apparatus comprising:

a spool axially movable within a cavity, wherein a first chamber is located at a first axial end of the cavity and a second chamber is located at a second axial end of the cavity, wherein the volume of the first chamber and the second chamber varies depending upon the axial position of the spool within the cavity;

a valve movable between a first position and a second position, wherein in the first position the valve is configured to convey fluid from the fluid inlet to the first chamber and from the second chamber to the fluid outlet, and in the second position the valve is configured to convey fluid from the fluid inlet to the second chamber and from the first chamber to the fluid outlet; and a control system configured to control the movement of the spool and the valve; wherein:

the spool and the cavity are a first spool and a first cavity respectively, and the apparatus further comprises a first valve comprising the first spool, the first cavity, the first chamber and the second chamber; and the valve is a second valve and comprises a second spool axially movable within a second cavity, wherein a first chamber of the second valve is located at a first axial end of the second cavity and a second chamber of the second valve is located at a second axial end of the second cavity, wherein the volume of the first chamber and the second chamber varies depending upon the axial position of the second spool within the cavity.

2. An apparatus as claimed in claim 1, wherein the control system is configured to synchronise the movement of the spool with the valve, such that:

(i) when the valve is in its first position the control system is configured to move the spool in a first axial direction to increase the volume of the first chamber and decrease the volume of the second chamber, thus conveying fluid from the fluid inlet to the first chamber and from the second chamber to the fluid outlet; and (ii) when the valve is in its second position the control system is configured to move the spool in a second, opposite axial direction to increase the volume of the second chamber and decrease the volume of the first chamber, thus conveying fluid from the fluid inlet to the second chamber and from the first chamber to the fluid outlet.

3. An apparatus as claimed in claim 2, wherein:

movement of the spool in the first axial direction draws fluid from the fluid inlet into the first chamber and pushes fluid from the second chamber to the fluid outlet; and movement of the spool in the second, opposite axial direction draws fluid from the fluid inlet into the second chamber and pushes fluid from the first chamber to the fluid outlet.

4. An apparatus as claimed in claim 1, wherein the control system is configured to reciprocate the spool within the cavity and move the valve between its first position and second position, in such a manner as to provide an intermittent or regular flow of fluid through the fluid outlet.

5. An apparatus as claimed in claim 4, wherein, upon reciprocation of the spool within the cavity, fluid flows through the fluid outlet alternately from the first chamber and the second chamber.

6. An apparatus as claimed in claim 1, further comprising one or more actuators configured to move the first spool within the cavity, and the valve between the first position and the second position.

7. An apparatus as claimed in claim 6, wherein any or all of the one or more actuators comprise solenoid actuators, piezoelectric actuators or memory material actuators.

8. The apparatus as claimed in claim 2, wherein the first valve is movable between a first position and a second position, wherein in the first position the first valve is configured to convey fluid from the fluid inlet to the first chamber of the second valve and from the second chamber of the second valve to the fluid outlet, and in the second position the first valve is configured to convey fluid from the fluid inlet to the second chamber of the second valve and from the first chamber of the second valve to the fluid outlet.

9. An apparatus as claimed in claim 8, wherein the control system is configured to synchronise the movement of the second spool with the first valve, such that:

(iii) when the first valve is in its first position the control system is configured to move the second spool in a first axial direction to increase the volume of the first chamber of the second valve and decrease the volume of the second chamber of the second valve, thus conveying fluid from the fluid inlet to the first chamber of the second valve and from the second chamber of the second valve to the fluid outlet; and (iv) when the first valve is in its second position the control system is configured to move the second spool in a second, opposite axial direction to increase the volume of the second chamber of the second valve and decrease the volume of the first chamber of the second valve, thus conveying fluid from the fluid inlet to the second chamber of the second valve and from the first chamber of the second valve to the fluid outlet.

10. An apparatus as claimed in claim 9, wherein the control system is configured to reciprocate the spools within their respective cavities, and move the first valve and the second valve between their respective first and second positions, in such a manner as to provide a substantially continuous flow of fluid through the fluid outlet.

11. An apparatus as claimed in claim 10, wherein the control system is configured to apply stages (i), (ii), (iii) and (iv) in a specific sequence, so as to provide a continuous flow of fluid from the fluid inlet to the fluid outlet.

12. An apparatus as claimed in claim 11, wherein the sequence is (i), (iii), (ii), (iv), or the sequence is (iv), (ii), (iii), (i).

13. A method of operating an apparatus as claimed in claim 1, wherein in the apparatus the spool and the cavity are a first spool and a first cavity respectively, the apparatus further comprises a first valve comprising the first spool, the first cavity, the first chamber and the second chamber, and the valve is a second valve and comprises a second spool axially movable within a second cavity, wherein a first chamber of the second valve is located at a first axial end of the second cavity and a second chamber of the second valve is located at a second axial end of the second cavity, wherein the volume of the first chamber and the second chamber varies depending upon the axial position of the second spool within the cavity;

the method comprising, in sequence:

moving the spool to increase the volume of the first chamber of the first valve and decrease the volume of the second chamber of the first valve; and moving the spool to increase the volume of the second chamber of the first valve and decrease the volume of the first chamber of the first valve.

14. The method of claim 13, further comprising:

after moving the spool to increase the volume of the first chamber, moving the second spool to increase the volume of the first chamber of the second valve and decrease the volume of the second chamber of the second valve; and after moving the spool to increase the volume of the second chamber, moving the second spool to increase the volume of the second chamber of the second valve and decrease the volume of the first chamber of the second valve.

* * * * *